US005809924A

United States Patent [19]

Ambrico et al.

[11] Patent Number: 5,809,924

[45] **Date of Patent: *Sep. 22, 1998**

[54] CLUTCH CONTROLLED STEERING DEVICE

[76] Inventors: Salvatore Ambrico, 11680 NW. 24th St., Plantation, Fla. 33323; Mike Flavin, 3270 Seaward Dr., Pompano Beach, Fla. 33062; Kathleen Ambrico, 11680 NW. 24th St., Plantation, Fla. 33323

[ * ] Notice: The term of this patent shall not extend beyond the expiration date of Pat. No. 5,591,055.

[21] Appl. No.: 859,049

[22] Filed: May 20, 1997

[51] Int. Cl.[6] ..... B63H 5/12

[52] U.S. Cl. ..... 114/144 R; 440/53; 74/480 B

[58] Field of Search ..... 74/480 B, 525, 74/530, 494; 440/63, 6, 7; 114/144 R, 146

[56] References Cited

U.S. PATENT DOCUMENTS 3,922,996 12/1975 Meyer ..... 74/480 B 4,916,969 4/1990 Henning ..... 114/144 R 5,591,055 1/1997 Ambrico et al. ..... 440/6

5,632,657 5/1997 Henderson ..... 440/6

5,660,132 8/1997 Pasley ..... 114/144 R

*Primary Examiner*—Ed L. Swinehart

*Attorney, Agent, or Firm*—William F. Hamrock

[57] ABSTRACT

A steering device for a motor attached to a boat which device includes an elongated steering arm having electrical means for starting and stopping the motor, the steering arm secured within a clutch mechanism wherein clutch sleeves are tightly rotatably mounted within a circular plate mounted on an internal shaft causing a drag on the steering arm when moved vertically positioning the steering arm at a desired position and where horizontal movement of the steering arm steers the boat.

18 Claims, 5 Drawing Sheets

CLUTCH CONTROLLED STEERING DEVICE

FIELD OF THE INVENTION

The present invention generally relates to a steering device for electric trolling motors, and more particularly, to an improved and simplified clutch controlled steering device and handle with an electrically controlled switch for starting and stopping conventional electric trolling motors attached to the bow or stem of the boat.

DESCRIPTION OF THE PRIOR ART

Small boats used for fishing and recreation are generally powered by electric trolling motors. The trolling motor usually has a vertical support column with a submersible motor and propeller mounted at its lower end and a small handle near its upper end of the column for steering. However, the short handle is frequently not adequate for steering the boat for a number of reasons. In many cases, auxiliary steering devices are attached in some manner to the trolling motor to provide an alternate means of steering the boat.

Many of the prior art auxiliary steering devices are attached to the trolling motor in a fixed position and the steering device cannot be raised or lowered vertically to other positions. The result is that these devices cannot be adjusted to other vertical positions to be operated by a person either standing up or sitting down or be operated by a person's foot at a low position. Also, because of the fixed position of the attached steering arms of these devices, they are inadequate for steering the boat in all types of weather and surf conditions so that the auxiliary steering arm would provide drag when the handle is raised or lowered to a different position to be held firmly at that desired height position.

These problems have been overcome by U.S. Pat. No. 5,591,055 for Clutch Controlled Adjustable Steering Device by two of the present inventors. The present invention is an improvement and simplification of that steering device in a manner to be described.

It is the object of the present invention to provide an adjustable steering device attached to conventional trolling motors which device having an improved steering arm that can be raised or lowered vertically to various positions.

It is another object of the present invention to provide an improved adjustable auxiliary steering device having an improved steering arm which can be operated by a person standing or sitting or by a person's foot.

It is a further object of the present invention to provide an improved adjustable auxiliary steering device having a steering arm enclosing electrical wiring having an improved On/Off switch controlling the starting and stopping the motor.

It is a further object of the present invention to provide an improved adjustable auxiliary steering device having an improved clutch mechanism providing drag when the steering arm is raised or lowered vertically to the desired steering height.

These and other objects will be readily evident upon a study of the following specification.

SUMMARY OF THE INVENTION

The present invention advantageously provides an improved adjustable clutch controlled steering device for electric trolling motors connected to the bow or stern of the boat in accordance with one feature of the invention, the present improved steering device includes an elongated longitudinal handle arm which encompasses wiring means and switch means in communication with the trolling motor. The wiring means are completely air tight and water proofed for efficiency and safety. Means operatively connect the wiring means to the motor. Switch means are set at the tip of the handle at the user's finger tips for immediately controlling the starting and stopping of the motor. Thus, the improved handle not only controls the steering device but also controls the operation of the motor.

A unique clutch adapter is fixed within the steering device by triple securing means in delivering the wiring through the system. A soft foam handle grip provides for comfort and insulation from extreme temperature conditions.

There are twin clutch sleeves contacted by set screws which provide drag on the handle arm when it is raised or lowered vertically which in turn rotates the clutch housing. The drag on the steering arm allows it to be held firmly within the mechanism at the desired height. This permits the steering handle arm to be operated by a person when standing, sitting or operated by foot. The clutch mechanism holds the handle arm in that position. There is no need to lock or unlock the handle arm in place in the clutch mechanism. The drag may be increased in the clutch mechanism by tightening the set screws to press on twin plastic clutch sleeves more tightly on an inner clutch shaft to set the desired drag for vibration and severe wave pounding conditions.

In accordance with a second feature of the invention, improved plate retainer engaging means more securely sandwiches the clutch mechanism on the inner clutch shaft are provided for more efficient operation of the clutch mechanism. The use of durable plastic elements, corrosion resistant metal elements and corrosion resistant screws provide a long lasting and lubrication free assembly.

Other advantages of the present invention, and a fuller appreciation of its mode of construction and operation, will be gained upon examination of the following detailed description of the preferred embodiments taken in conjunction with the figures of the drawings.

DETAILED DESCRIPTION OF THE PREFERRED EMBODIMENT

Figure 1:
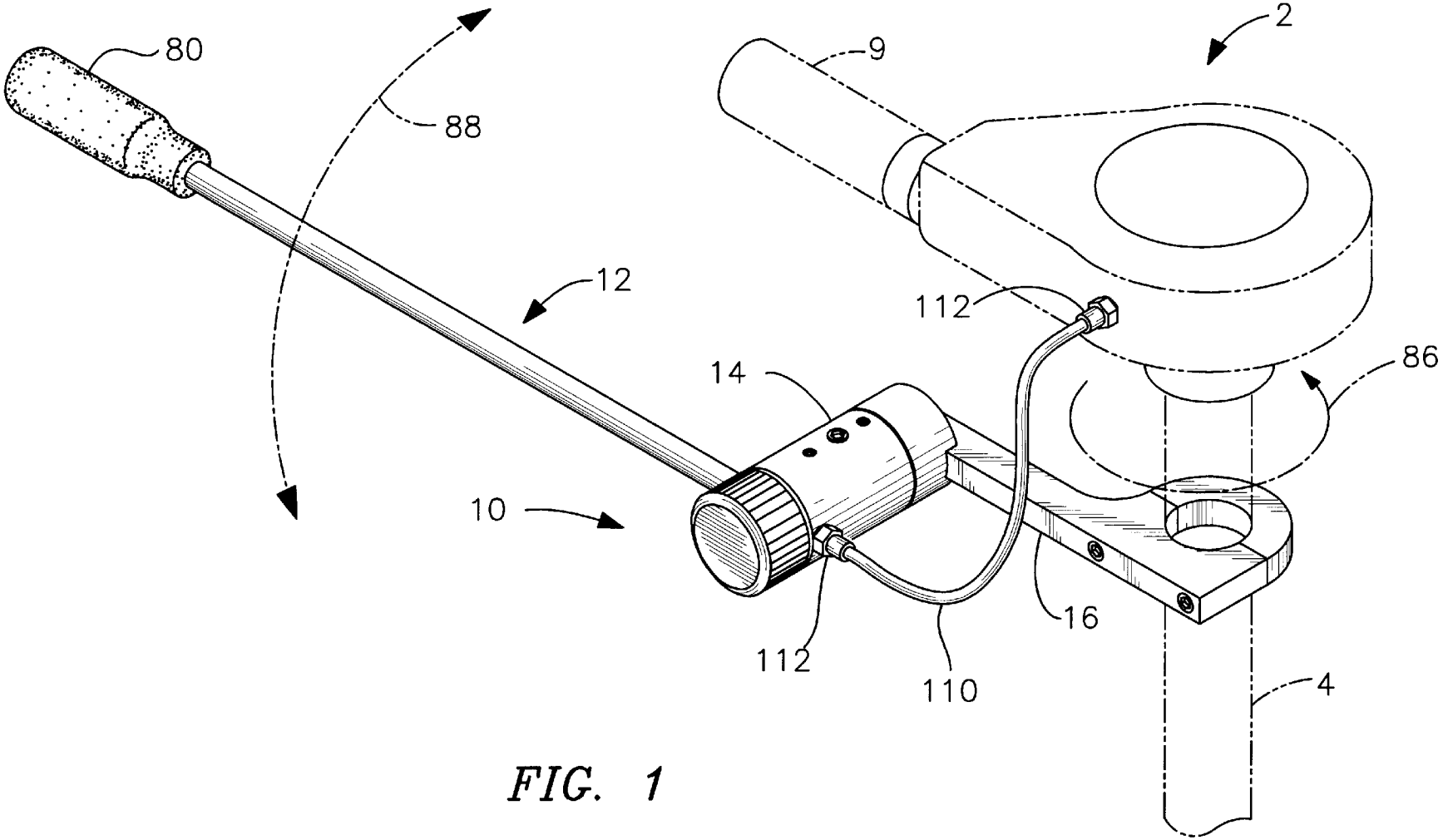
FIG. 1 is a side view showing a conventional trolling motor with the improved adjustable steering device of the invention mounted on the vertical column of the trolling motor with wiring connected to the motor.

Referring more specifically to FIG. 1, the present invention relates generally to trolling motor operated fishing boats or similar boats wherein a boat of conventional design not shown has mounted thereon an electric trolling motor 2 which may be mounted on the bow or front end of the boat. The trolling motor 2 includes a vertical column 4 generally about one inch in diameter having a submersible motor driven propeller not shown mounted at its lower end. Generally, a small handle 9 is provided at its upper end for steering the boat about its vertical axis.

The clutch controlled adjustable steering device 10 of the present invention includes an elongated steering arm 12 made of aluminum enclosing the electric wiring and switch and mounted near the front of clutch mechanism 14. The clutch mechanism 14 is in fixed attachment to clamp bracket 16 which in turn is rigidly attached to trolling motor vertical column 4 below small handle 9 so that the vertical column can be turned about to its vertical axis is the steering of the boat.

Figure 2:
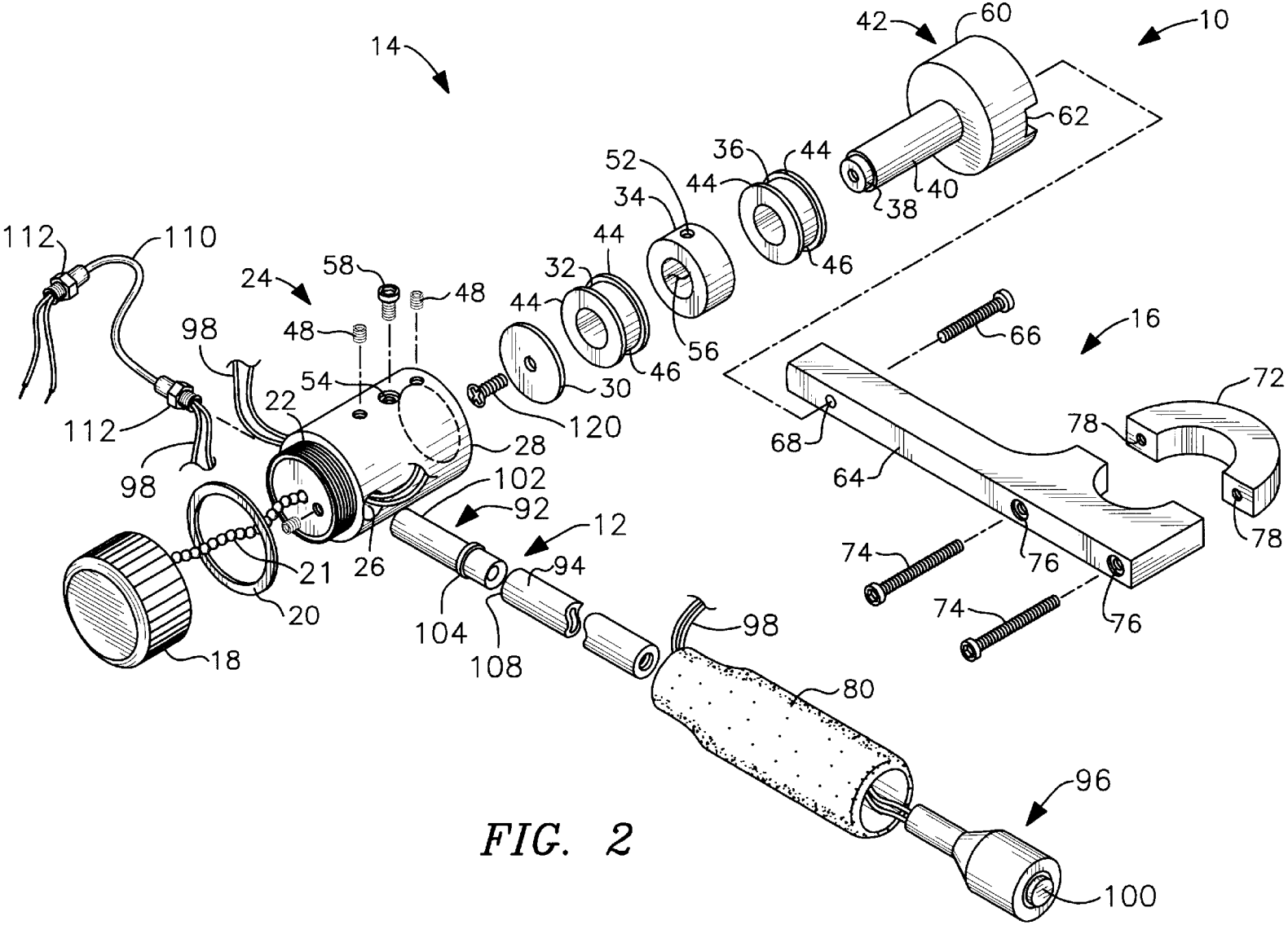
FIG. 2 is an exploded view of the improved adjustable steering device of the invention showing wiring in the handle arm.

The elongated steering arm 12 as seen in FIG. 2 is divided into cylindrical clutch adapter 92, cylindrical shaft handle 94 and switch adapter 96 from which wiring 98 from switch 100 originates passing through to the motor. Clutch adapter 92 has a front section 102, external shoulder ring 104 and a rear section 106. Front cylindrical section 102 extends through aperture 26 in outer clutch housing 24 where shoulder ring 104 abuts the outer clutch housing. Rear cylindrical section 106 extends rearwardly into the front bore 108 of shaft handle 94 where it is frictionally engaged with the shaft handle abutting the shoulder ring. When clutch adapter 92 and shaft handle 94 are joined together, they define an internal cylindrical passageway through which wiring 98 extending from switch adapter 96 through clutch housing 26. Generally cylindrical clutch adapter 92 has an outside diameter of about 0.492 inch and its rear cylindrical section extends about one and one half inches into shaft handle 94 having an inside diameter slightly more than 0.492 inch to provide a tight frictional fit.

Figure 7:
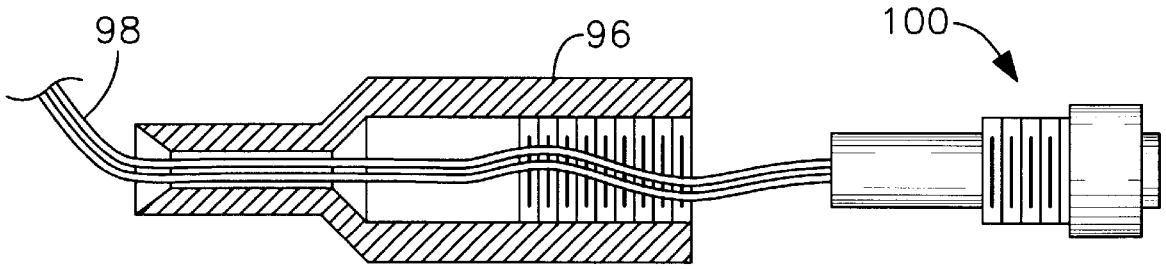
FIG. 7 is an exploded view of the switch adapter and switch.

Switch adapter 96 as seen in FIGS. 2 and 7 has a small cylindrical front section which extends into the opposite rear end of shaft handle 94 about one and one half inches for tight fit. The rearward section of switch adapter 96 has an enlarged cylindrical threaded portion adapted to receive the front section of electric switch 100. Generally, the rear section of switch adapter 96 extends rearwardly about three inches to accommodate On/Off push button switch 100.

Attached on the opposite side of clutch housing 26 is elongated nylon tubing 110 or similar tubing having an externally threaded air fitting screw 112 at each end. One end of the fitting screw is threadedly connected to the front internal end of the clutch adapter front section 102 having interior threads and the opposite end is threadedly connected to motor head 114 which is operatively connected to trolling motor 2 in a known manner. The nylon tubing 110 forms an air tight and water proof seal on the wiring.

Clutch steering device 10 is shown more clearly in the exploded view seen in FIG. 2. Clutch mechanism 14 has attached at its front end a locking knob 18 made of aluminum having interior threads. Locking knob 18 is mounted on friction washer 20 preferably made of a durable plastic such as delrin, on the threaded neck 22 and releasably attached by chain 21 to the closed solid front end of outer clutch housing 24 also made of aluminum shown in FIG. 3. Outer clutch housing 24 is provided with aperture 26 extending therethrough adjacent to threaded neck 22 through which clutch adapter is releasably held in place axially within aperture 26 by a combined triple securing means. One component of the triple securing means is shoulder ring 104 abutting clutch housing 24 at aperture 26. The second component of the securing means as seen in FIG. 2 is set screw 116 set within the front end of the clutch housing so as to frictionally connect front cylindrical section 100 within the aperture. The third component of the securing means is the threaded connection of the front section 102 of the clutch adapter with air fitting 112. The combined triple securing means firmly affix steering arm 12 to clutch mechanism 14.

Figure 4:
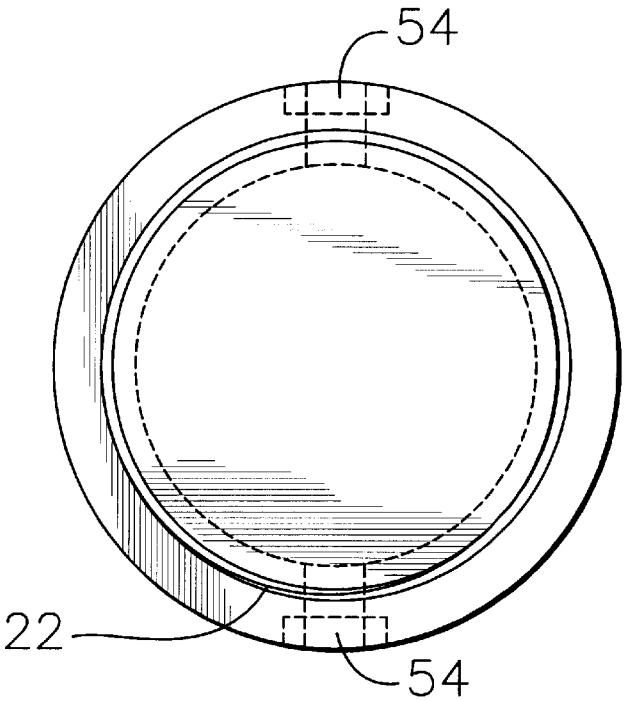
FIG. 4 is a rear end view of the outer clutch housing.
Figure 3:
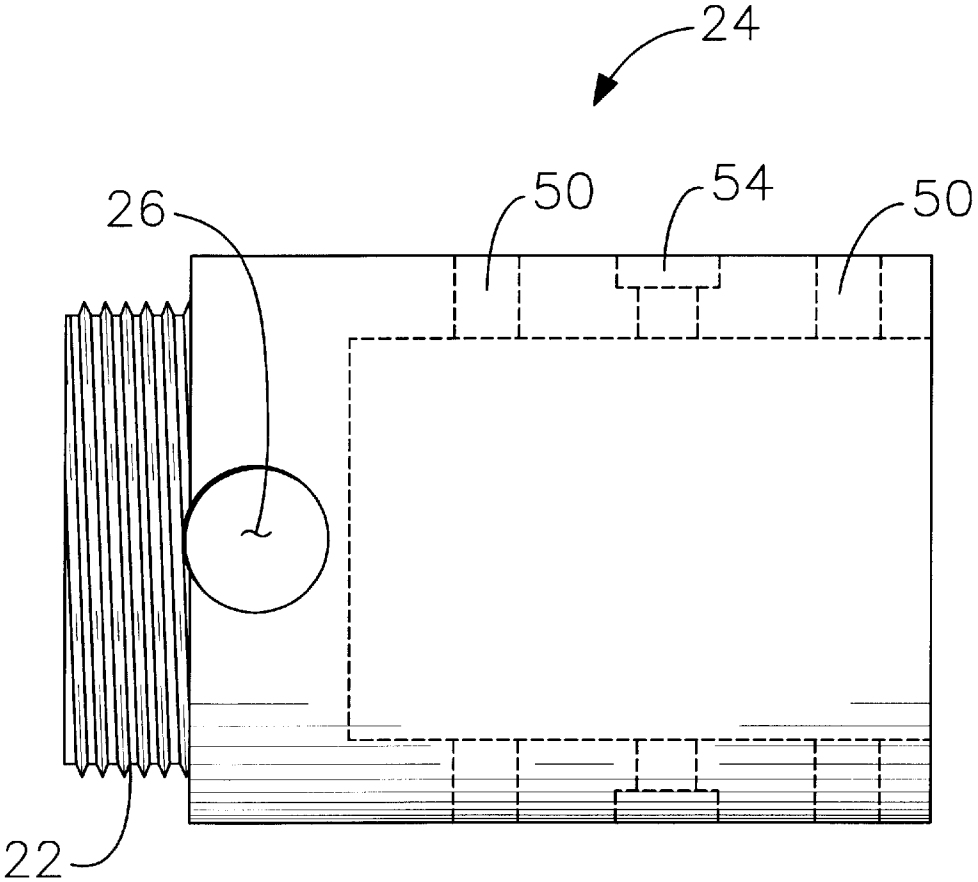
FIG. 3 is a side view of the outer clutch housing.
Figure 5:
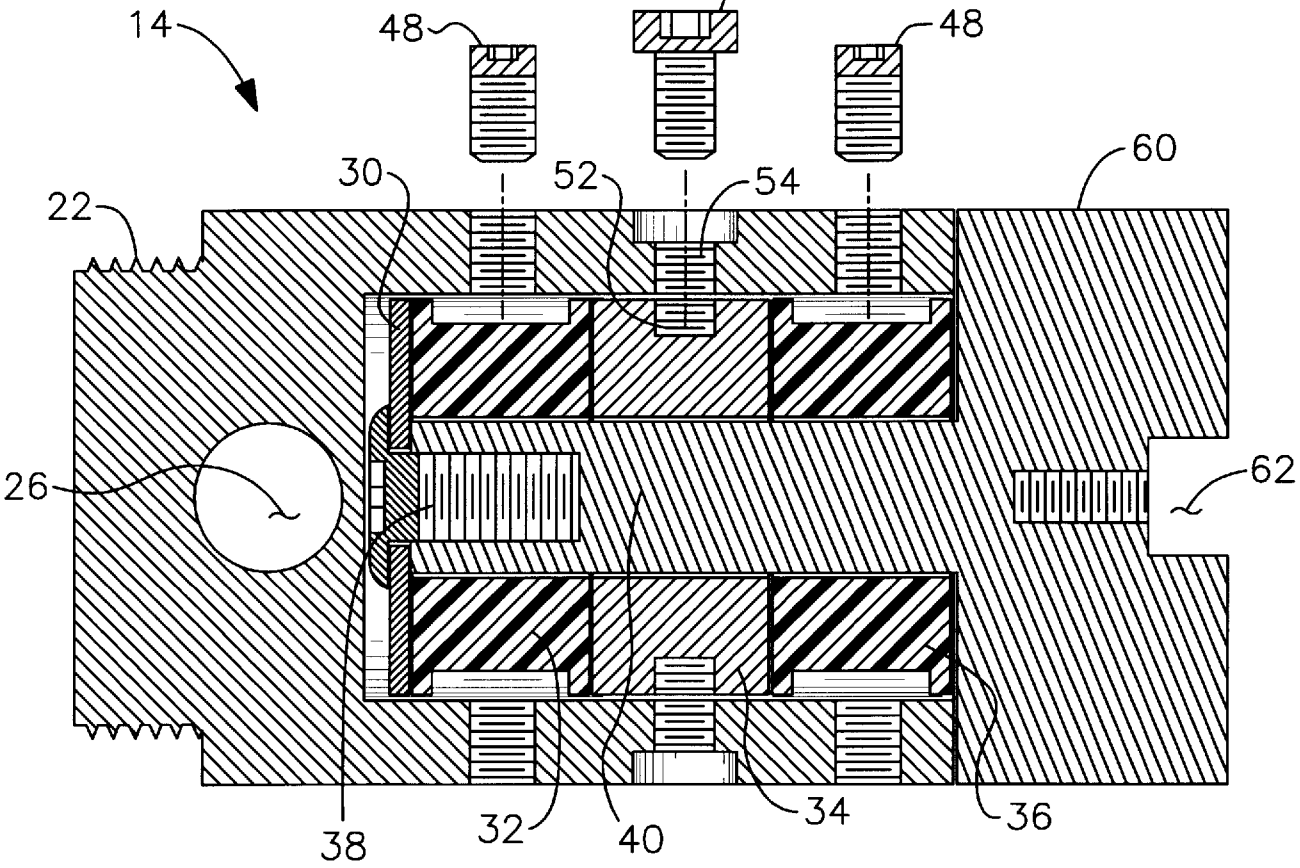
FIG. 5 is a sectional view of the clutch mechanism.
Figure 6:
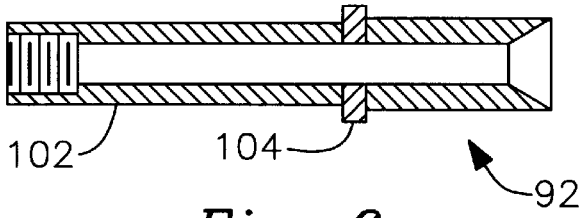
FIG. 6 is a view illustrating the clutch adapter.

Outer clutch housing 24 as seen in FIGS. 2, 3 and 4 is a cylindrical element closed at its threaded front end and open at its rear end forming a hollow cylindrical interior 28 therein. Sequentially housed within the hollow interior of outer clutch housing 24 are improved clutch retainer plate 30, front clutch sleeve 32, thrust retainer sleeve 34 and rear clutch sleeve 36 which are secured on tip 38 of shaft 40 of inner clutch housing 42. As seen in FIGS. 2 and 5, the forwarding extending tip 38 of shaft 40 has a centrally threaded opening 116 adapted to receive screw 118 through central orifice 122 of retainer plate 30.

Clutch retainer plate 30 is preferably an aluminum plate which is affixed to front clutch sleeve 32 by screw 120 that passes through central orifice 122 and is threaded into opening 118 of shaft tip 38 to hold front clutch sleeve 32, thrust retainer sleeve 34 and rear clutch sleeve 36 securely together on shaft 40. Front and rear clutch sleeves 32 and 36 are identical durable plastic cylindrical disks, preferably made of black delrin plastic, adapted to fix tightly on each side of thrust retainer sleeve 34 on shaft 40 of inner clutch element 42. The exterior surfaces of the clutch sleeves 32 and 36 have ledges 44 extending upwardly at each end thereof having an outside diameter adapted to fit snugly and tightly within the cylindrical hollow interior 28 of the outer clutch housing. Each clutch sleeve 32 and 36 is secured in the desired location within the interior 28 of outer clutch housing 24 by two opposing spaced apart set screws 48 disposed within the tap holes 50 within the opposite side of the outer clutch housing. Preferably, two set screws are required for each clutch sleeve 32 and 36. The set screws 48 are tightened until they exert sufficient force upon the outer interior surface 46 having a diameter slightly smaller than the diameter of ledges 44 of clutch sleeves 32 and 36. Since engaging the set screws on the plastic surface to press against the surface shaft 40 can irritate and roughen the outer interior surface 46, the smaller sized diameter of the outer interior surface 46 prevents contact with the clutch housing and overcomes problems arising from the outer interior surface contacting the interior wall of the outer clutch housing even if the interior surface has been roughened.

As seen in FIG. 2, thrust retainer sleeve 34 is located between front clutch sleeve 32 and rear clutch sleeve 36. Thrust retainer sleeve 34 is a cylindrical disk made of aluminum having preferably two opposing spaced apart threaded holes 52. Threaded holes 52 are aligned with clearance holes 54 disposed within the outer clutch housing 24. Thrust retainer sleeve 34 is attached to outer clutch housing 24 by suitable screws 58, preferably Allen screws, passing through clearance holes 54 of the outer clutch housing and being threadedly secured within the aligned threaded holes 52 of the thrust retainer sleeve 34 which secures the interior elements 30, 32, 34, 36, 38 and 40 to the outer clutch housing 24. The interior diameter of axial opening 56 of thrust retainer sleeve 34 is slightly larger than the diameter shaft 40 in order to prevent metal to metal contact between the thrust retainer sleeve 34 and shaft 40 thus eliminating any drag resulting from such a metal to metal contact in the operation of the adjustable steering device 10.

Inner clutch element 42 is made of aluminum and includes the round elongated solid shaft 40 extending longitudinally forward from a cylindrical block 60 and having central threaded opening 118 located at forwarding extending tip 38 to engage screw 120. As shown in FIG. 2, shaft 40 and tip 38 extend within hollow opening 28 of the outer clutch housing through the axial openings of thrust retainer sleeve 34 and clutch sleeves 32 and 36. The shaft is then tightly secured to clutch retainer plate 30 which secures the inner clutch element 42 within outer clutch housing 24. Extending across the rear of cylindrical block 60 is an indented area 62 into which clamp arm 64 is inserted and attached therein by means of a flat head screw 66, such a a flat head Allen screw, fitted into central tap hole 68 and into a central tap hole in indented area 62 of cylindrical block 60.

Clamp bracket 16 which is made of aluminum includes solid clamp arm 64 and solid arcuate shaped clamp member 72. Clamp arm 64 as previously discussed is releasably attached at one end within the indented area 62 to cylindrical block 60 by means of flat head screw 66 inserted through clamp arm tap hole 68 and central tap hole in the cylindrical block. At the other end, clamp arm 64 and clamp member 72 are adapted to encircle and to be rigidly attached to vertical column 4 of the trolling motor by means of screws 74, preferably Allen screws, passing through aligned arm clamping clamp holes 76 and clamp member holes 78. Clamp bracket 16 can be attached at any position on column 4.

As seen in FIGS. 1 and 2, a soft foam handle grip 80 is provided on the front end of a steering arm 12 by means of a securing means such as adhesive preferably epoxy. The soft foam handle grip is provided for comfort and insulation from extreme temperature conditions that may be conducted along the aluminum steering arm 12, preferably a high tensile aircraft grade aluminum steering arm.

In carrying out the invention, elongated steering arm 12 with handle grip 80 attached thereto is secured within steering aperture 26 in outer clutch housing 24. Generally, steering arm 12 is about thirty two inches in length. Steering arm 12 is locked in place within steering arm aperture 26 by the triple securing means holding clutch adapter 92 within aperture 26 in conjunction with the frictionally engaged shaft handle 94 with the rear cylindrical section of the clutch adapter with the front section of switch adapter 96 in combination with the wiring and wiring attachments. It will be seen that with the steering arm secured in place as described so far, a person grasping the handle grip 80 and steering arm 12 at any position to the front of the steering arm and moving the rod longitudinally will turn column 4 and the trolling motor about its vertical axis as indicated by arrow 86 and will thus steer the boat.

Steering arm 12 can now be raised or lowered vertically as indicated by arrow 88 to the desired longitudinal position desired for steering the boat. This is accomplished by moving the steering arm 12 vertically up or down which causes the outer clutch housing 24 to rotate about its longitudinal axis forcing the set screw connected thrust retainer sleeve 34 to rotate about its longitudinal axis about shaft 40 without coming in contact with the shaft surface and avoiding metal to metal contact therewith. At the same time, set screws contacted twin clutch sleeves 32 and 36 rotate and cause the exterior sleeves inner surface to press against the exterior surface of shaft 40 causing a various amount of drag on the clutch mechanism 14 due to the intensity of the tightening of the set screws pressing against the twin clutch sleeves plastic surfaces, preferably delrin plastic. The drag on the clutch mechanism, allows the steering arm to be held firmly in the desired vertical position. There is no need to lock or unlock the handle arm in place in the clutch mechanism. The drag may be increased by tightening the set screws in the twin clutch sleeves 32 and 36 to press on the plastic twin clutch sleeves more tightly against shaft 40 in order to set the desired drag to overcome and neutralize vibration and severe wave pounding conditions. Thus, the steering arm can be raised or lowered vertically to any desired position which allows the person to steer the boat by standing up, sitting down or with one's foot. The use of durable plastic twin clutch sleeves and friction washer along with corrosion resistant aluminum preferably 6061, and corrosion resistant screws preferably stainless steel screws provide a long lasting lubrication free assembly.

Figure 8:
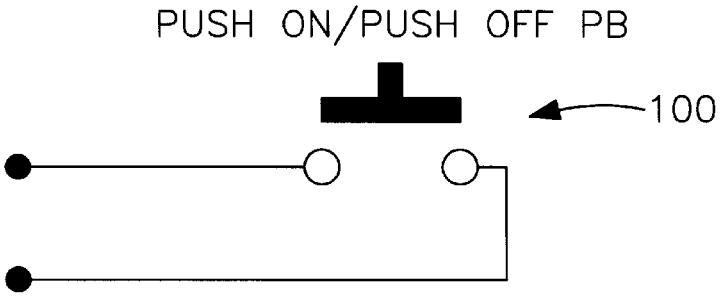
FIG. 8 is a schematic illustrating the On/Off switch.

The On/Off push button switch illustrated in FIG. 8 is located at the tip of steering arm 12 in back of handle grip 80. The switch button extends outwardly about three eighths of an inch so that it is at the user's finger tips for immediately controlling the starting and stopping of the motor. Thus, the controlled starting and stopping of the motor is now available to the boat operator while it is hidden in the steering arm and safely enclosed within nylon tubing which has eliminated unsafe conditions of exposed wiring.

Generally, the overall dimensions for the steering device are: the handle arm is about 32 inches in length, the outer clutch housing is about 2 inches in length and its outside diameter is about one and three quarter inches with the central hollow interior is about one and a quarter inches in diameter, the clutch retainer ring is about 1.74 inches outside diameter having an axial opening of about 1.187 inches, locking knob 18 is about 1¾ inches outside diameter and slightly less than one inch in length, clutch sleeves 32 and 36 are about one and a quarter inch in outside diameter, about 0.85 inch axial opening, about 0.375 inch thickness and each ledge being about 0.06 inch in width, the thrust retainer sleeve 34 is about 1.25 inches outside diameter, about 0.85 inch inside diameter and about 0.365 inch in thickness, the inner clutch element is about 1.75 inches outside diameter for the block 60 and about 0.25 inch thickness, and the indented area is about 0.065 inch deep and 0.754 inch in width, shaft 40 is about 1.125 inches in length and about 0.75 inch in diameter, clamp bracket 16 is about 5.75 inches in length and the clamp arm 64 is about 0.75 inch in width.

Obviously, many modifications and variations, herinbefore set forth, may be made without departing from the spirit and scope thereof, and therefore only such limitations should be imposed as are indicated in the appended claims.

What is claimed is:

1. A steering device for a motor having a motor head and a vertical steering column for turning the motor about its axis attached to the bow or stern of a boat, comprising an adjustable clutch controlled steering device having an elongated steering arm connected to a cylindrical casing encompassed clutch mechanism connected horizontally to the vertical steering column, said clutch mechanism having at least one clutch sleeve enclosed therein having axial opening rotatably mounted on a longitudinal shaft extending therein, electrical means in the steering arm operatively connected to the motor, the arrangement being such whereby the electrical means control the starting and stopping of the motor.

2. A steering device according to claim 1 wherein the steering arm provides a passageway for electrical wiring in communication with the motor.

3. A steering device according to claim 2 wherein the wiring originates from a switch provided on the steering arm.

4. A steering device according to claim 3 wherein the switch is an ON/OFF push button switch.

5. A steering device according to claim 4 wherein the steering arm provides a handle and the switch is located at the handle.

6. A steering device according to claim 5 wherein the electrical wiring is adapted to connect to the motor head in communication with the motor.

7. A steering device according to claim 1 wherein the steering arm comprises a cylindrical clutch adapter releasably mounted within the clutch mechanism.

8. A steering device according to claim 7 wherein the steering arm further comprises a cylindrical shaft handle mounted on said clutch mechanism.

9. A steering device according to claim 8 wherein the steering arm further comprises a cylindrical switch adapter mounted on the shaft handle.

10. A steering device according to claim 9 wherein a switch is mounted on the switch adapter.

11. A steering device according to claim 10 wherein wiring originates from the switch and passes within the switch adapter the shaft handle and the clutch adaptor to the motor.

12. A steering device according to claim 11 wherein the wiring from the clutch adapter passes through tubing to the motor.

13. A steering device according to claim 12 wherein the wiring from the tubing is adapted to connect to the motor head in communication with the motor.

14. A steering device according to claim 1 wherein there are first and second clutch sleeves and the clutch sleeves and shaft are mounted within a cylindrical opening in a casing wherein the clutch sleeves are pressed against the shaft to cause drag.

15. A steering device according to claim 14 wherein a cylindrical disk having an axial opening is tightly positioned between outer and inner clutch sleeves.

16. A steering device according to claim 15 wherein a circular plate is tightly secured in front of the outer clutch sleeve.

17. A steering device according to claim 16 wherein the circular plate provides a central opening through which it is securely mounted on the shaft.

18. A method of controlling the starting and stopping and the steering of a boat having a motor connected to a vertical steering column comprising mounting horizontally on said column an adjustable cylindrical casing encompassed clutch controlled steering device having at least one clutch sleeve enclosed rotatably mounted on a longitudinal shaft extending therein, mounting an electrical wiring means within the steering arm operatively connected to the motor, moving the steering arm vertically to rotationally move the cylindrical casing and clutch sleeve causing drag within the clutch controlled steering device positioning the steering arm at a desired position, moving the steering arm horizontally causing the column to steer the boat, pressing a switch of the electrical wiring means starts and stops the motor.

* * * * *